United States Patent [19]

Miller

[11] 4,103,795

[45] Aug. 1, 1978

[54] LIFTING AND LOADING DEVICE

[75] Inventor: Dennis M. Miller, Andover, England

[73] Assignee: Automatic Container Loading Limited, England

[21] Appl. No.: 697,448

[22] Filed: Jun. 18, 1976

Related U.S. Application Data

[63] Continuation-in-part of Ser. No. 534,446, Dec. 19, 1974, abandoned.

[51] Int. Cl.[2] ..... B66F 9/14

[52] U.S. Cl. ..... 214/621; 214/38 CC; 214/515; 280/43.12; 280/43.13

[58] Field of Search ..... 214/515, 520, 620, 621, 214/38 CC; 280/43.12, 43.13; 254/2 C

[56] References Cited

U.S. PATENT DOCUMENTS

| | | | |
|---|---|---|---|
| 2,598,151 | 5/1952 | Warshaw | 280/43.12 X |
| 2,760,661 | 8/1956 | Wight et al. | 214/620 |
| 2,796,186 | 6/1957 | Arnot | 214/620 X |
| 2,833,435 | 5/1958 | Levy | 214/515 |
| 2,944,689 | 7/1960 | Arnot | 214/620 |
| 3,480,167 | 11/1969 | Varilek | 214/620 |
| 3,601,423 | 8/1971 | Goodacre | 280/43.12 |

FOREIGN PATENT DOCUMENTS

| | | | |
|---|---|---|---|
| 116,353 | 3/1969 | Norway | 280/43.12 |
| 453,208 | 6/1968 | Switzerland | 280/43.12 |

*Primary Examiner*—L. J. Paperner

[57] ABSTRACT

This relates to a lifting and loading device which includes a power driven lift truck and an auxiliary lifting and loading device which is separable from the lift truck and is operable by the operator of the lift truck while being disposed thereat, the auxiliary lifting and loading device being provided with hydraulic power units which are controlled by electrical actuators and therebeing both hydraulic and electrical lines extending between the lift truck and the auxiliary lifting and loading device wherein by way of electrical control means on the lift truck, the actuation and operation of the auxiliary lifting and loading device may be effected remotely. The lift truck is provided with a lifting member having an upper horizontally extending edge and the auxiliary lifting and loading device is provided with a pair of transversely spaced hooks which are engageable with the lifting member and there being guide means between the lifting member and the hooks wherein the auxiliary lifting and loading device is automatically centered relative to the lift truck and is held in position on the lifting member. The auxiliary lifting and loading device has a primary single wheel which is centered and which is both driven and steerable. There are stabilizing roller means carried on opposite sides of the single main wheel and there are means for raising and lowering the stabilizing roller means in response to raising and lowering of the lower part of the auxiliary lifting and loading device with respect to the main frame thereof.

30 Claims, 12 Drawing Figures

LIFTING AND LOADING DEVICE

Figure 1:
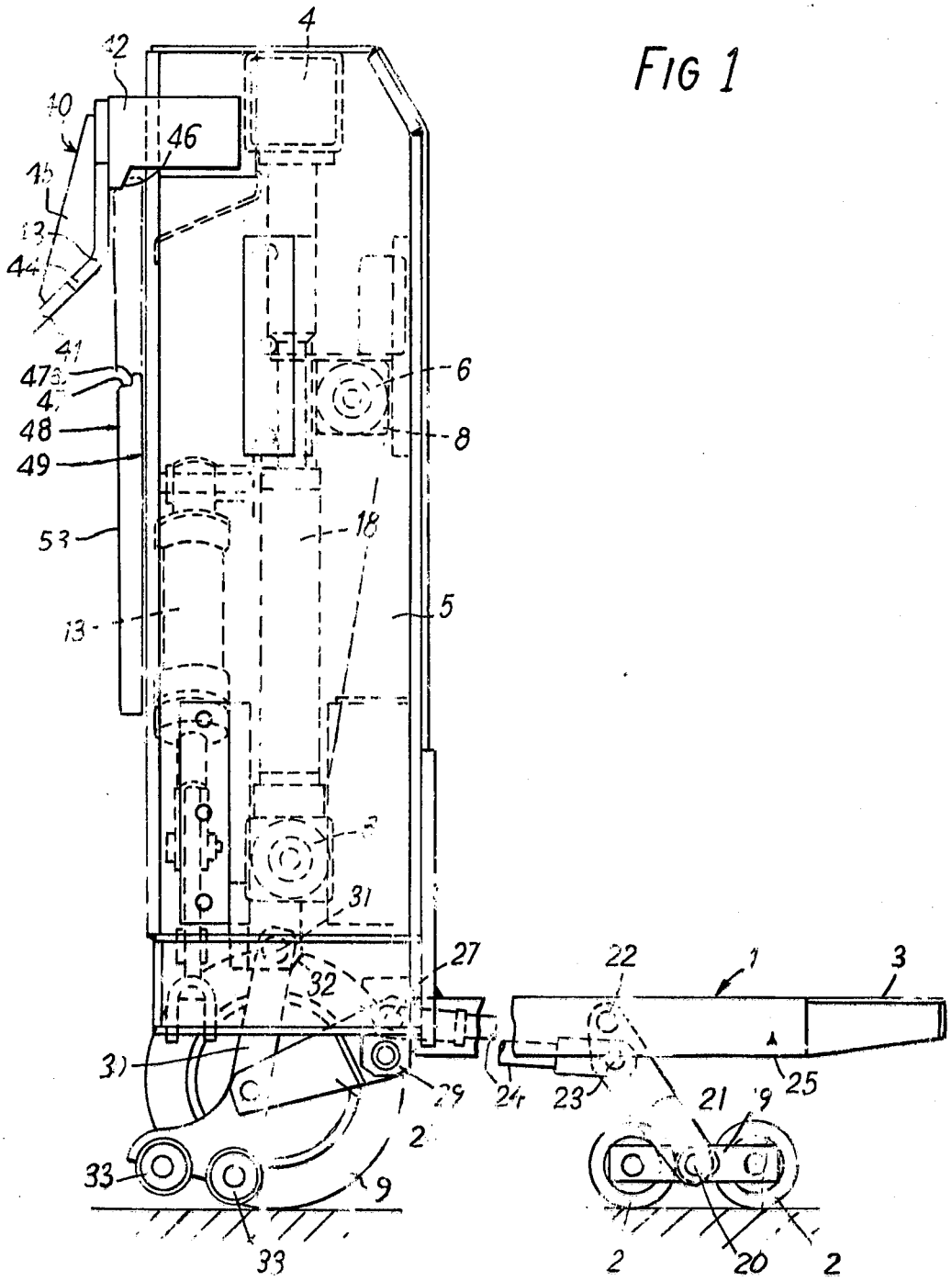

This is a continuation-in-part of Ser. No. 534,446, filed on Dec. 19, 1974 now abandoned.

This invention relates to an auxiliary lifting and loading device for use with a power driven lift truck and which is particularly although not exclusively applicable for use in loading articles or material into or out of transport containers.

Modern containers such as those of the I.S.O. type present a floor area some eight feet wide by twenty, thirty and forty feet long, having the loading door at one end. While certain weights can be placed into these containers by conventional means, those means have too low a weight limit and also impose very high concentrated loads on to the floor of the container causing damage and distortion and the present invention relates to a device which can be used for loading such containers without imposing such concentrated loads.

The present invention is intended to provide a lifting and loading device which can be used with a power driven lift truck such as fork lift truck or side-loader which will enable such a truck to load and unload containers even though the lift truck is too large to enter the container itself and the invention provides the means by which the load may be placed into position within the container at a maximum distance from the door opening. The capacity and size is limited only by the size and capacity of the truck or container.

According to one aspect of the present invention in the combination of a power driven lift truck and an auxiliary lifting and loading device said device is detachable from said lift truck and is individually operable from said lift truck; the improvement wherein said lift truck is provided with a vertically movable lifting assembly of the type including removable lifting elements for functioning independently of said auxiliary lifting and loading device and said lifting assembly includes a lifting member having an upper horizontally extending edge; and said auxiliary lifting and loading device including a horizontally extending lower part having support wheel means and support elements and height adjustment means for raising and lowering said lower part in relation to said support wheel means and said support elements, and a vertically extending upper part connected to said lower part, said upper part having hook elements for vertical movement therewith, said hook elements being configurated for interlocking engagement over said lifting member upper horizontally extending edge for releasably suspending said auxiliary lifting and loading device therefrom, said lifting member upper horizontally extending edge having a rearwardly facing portion which is oblique to a vertical plane and each of said hook elements having a horizontally extending portion and a downwardly extending portion, part of said horizontally extending portion having a downwardly facing surface which is oblique to a vertical plane for engagement over said oblique rearwardly facing portion on said lifting member when in interlocking engagement therewith.

According to another aspect of the invention in the combination of a power driven lift truck and an auxiliary lifting and loading device said device is detachable from said lift truck and is individually operable from said lift truck; the improvement wherein said lift truck is provided with a vertically movable lifting assembly of the type including removable lifting elements for functioning independantly of said auxiliary lifting and loading device and said lifting assembly includes a lifting member having an upper horizontally extending edge; and said auxiliary lifting and loading device includes a horizontally extending lower part having support wheel means and support elements and height adjustment means for raising and lowering said lower part in relation to said support wheel means and said support elements, and a vertically extending upper part connected to said lower part, said upper part having hook elements for vertical movement therewith, said hook elements being configurated for interlocking engagement over said lifting member upper horizontally extending edge for releasably suspending said auxiliary lifting and loading device therefrom, and stabilizing rolling means carried by said auxiliary lifting and loading device adjacent said support wheel means, and means for lowering and raising said stabilizing rolling means in response to raising and lowering said lower part in relation to said support wheel means and said support elements.

The invention also includes the combination of a power driven lift truck and an auxiliary lifting and loading device wherein said auxiliary lifting and loading device is detachable from said lift truck and is individually operable from said lift truck; the improvement wherein said lift truck is provided with a vertically movable lifting assembly of the type including removable lifting elements for functioning independantly of said auxiliary lifting and loading device and said lifting assembly includes a lifting member having an upper horizontally extending edge; and said auxiliary lifting and loading device includes a horizontally extending lower part having support wheel means and support elements and height adjustment means for raising and lowering said lower part in relation to said support wheel means and said support elements, and a vertically extending upper part connected to said lower part, said upper part having hook elements for vertical movement therewith, said hook elements being configurated for interlocking engagement over said lifting member upper horizontally extending edge for releasably suspending said auxiliary lifting and loading device therefrom, and guide means on said lifting member which operatively act on said auxiliary lifting and loading device to locate it in a predetermined horizontal position on said lifting member when said hook elements are engaged over said lifting member.

In a preferred construction rollable support means are carried by said support elements for co-operation with said support wheel means for supporting said auxiliary lifting and loading device independantly of said lift truck, and means for extending and retracting said rollable support means in response to operation of said height adjustment means for raising and lowering said lower part.

The auxiliary lifting and loading device can include a support frame carrying said support wheel means a lifting frame guidably carried by said support frame, and lift means extending between said support frame and said lifting frame for vertically moving and positioning said lifting frame relative to said support frame a lower portion of said lifting frame providing said horizontally extending lower part of said auxiliary lifting and loading device and carrying said rollable support means and also having an upper portion which provides said vertically extending upper part of said auxiliary lifting and loading device and carrying said hook elements.

Figure 2:
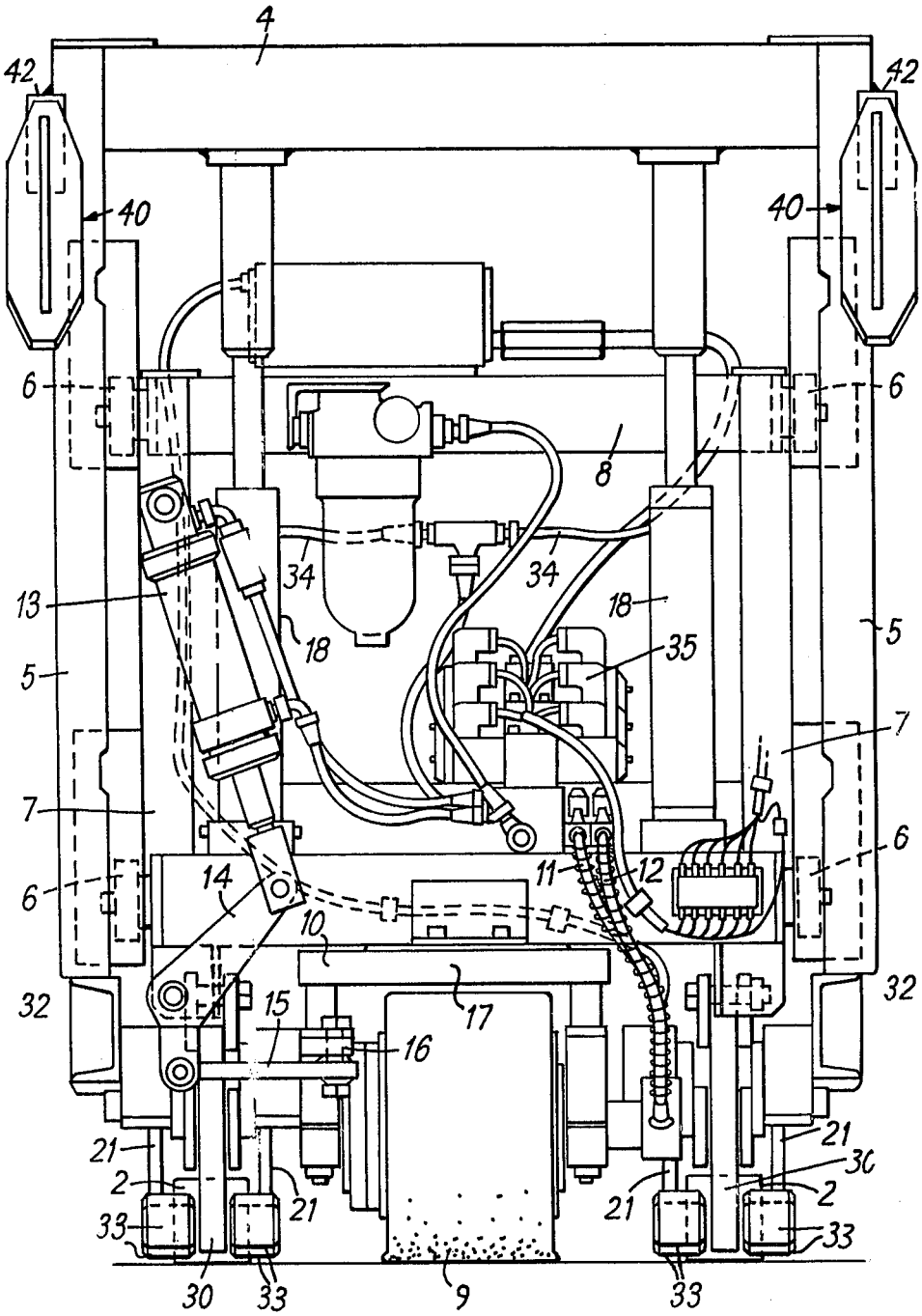
Figure 3:
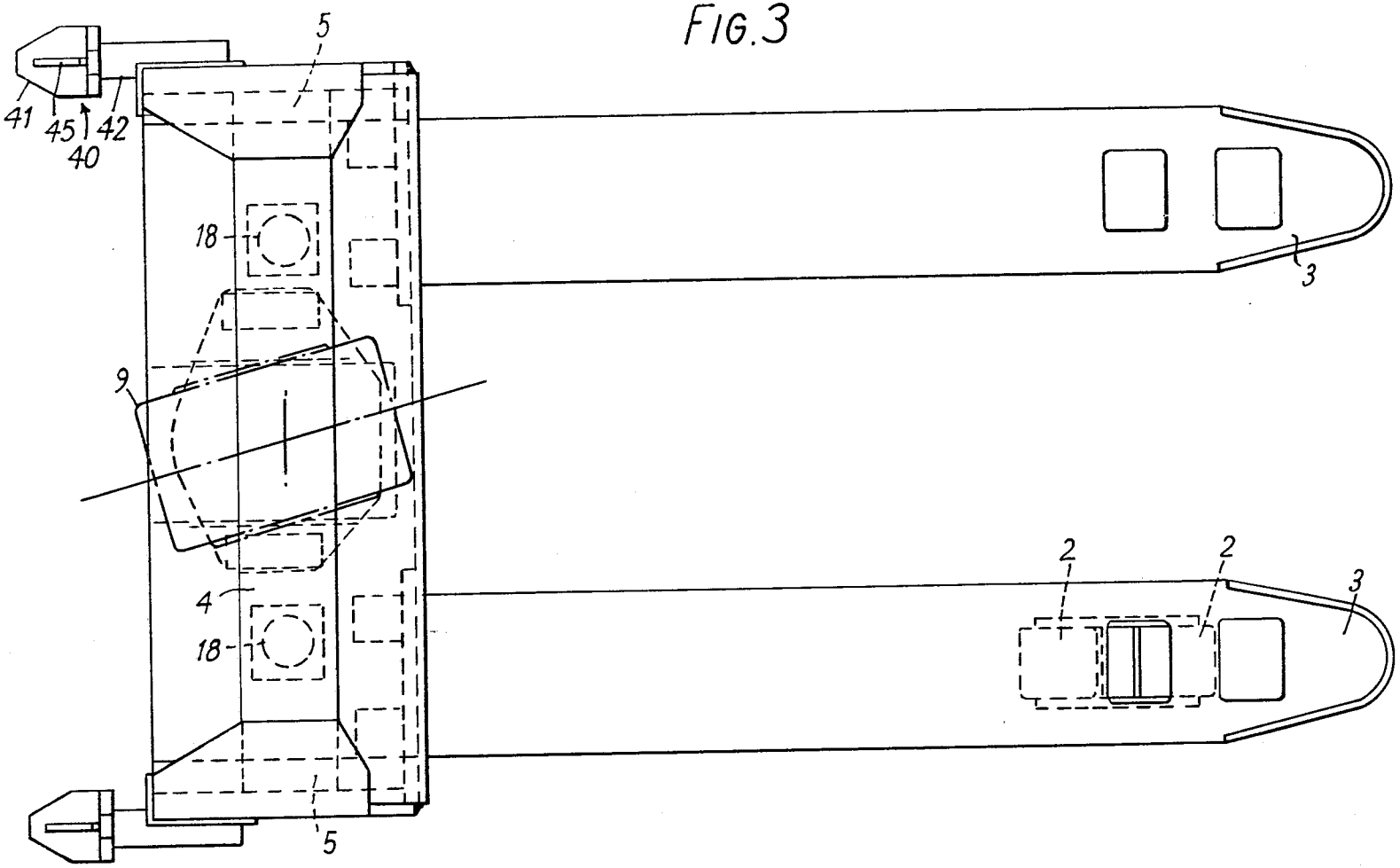
Figure 4:
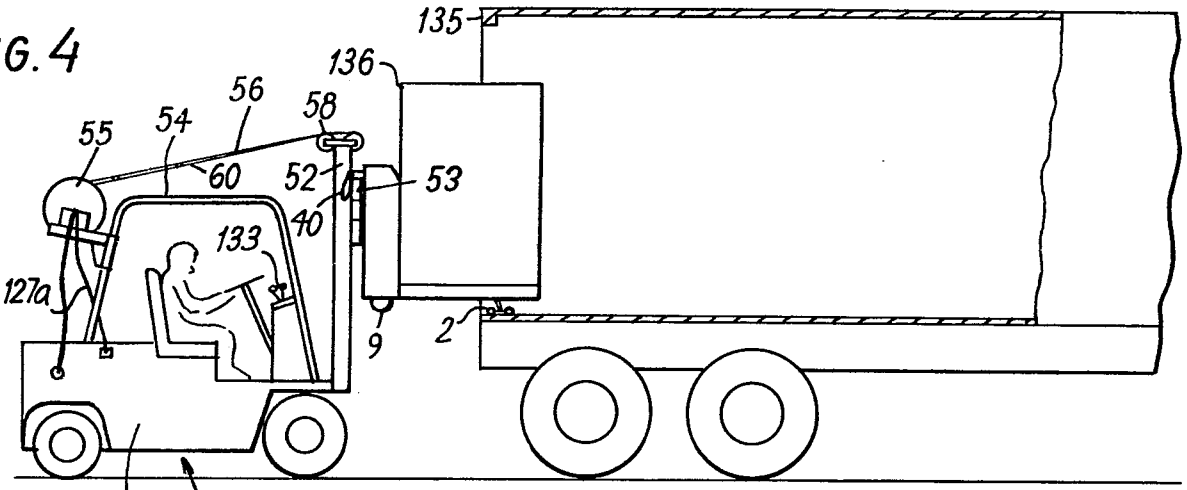
Figure 5:
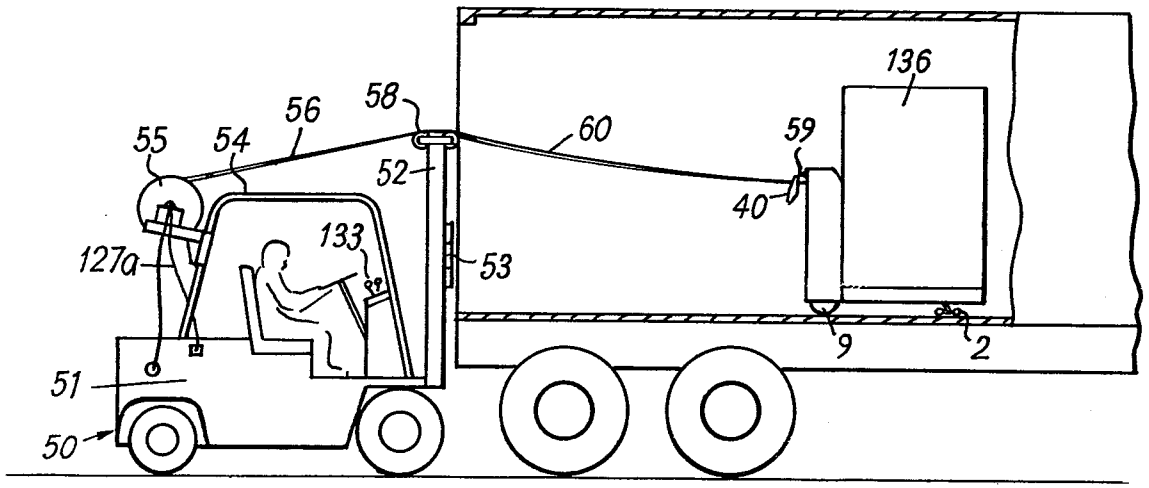
Figure 6:
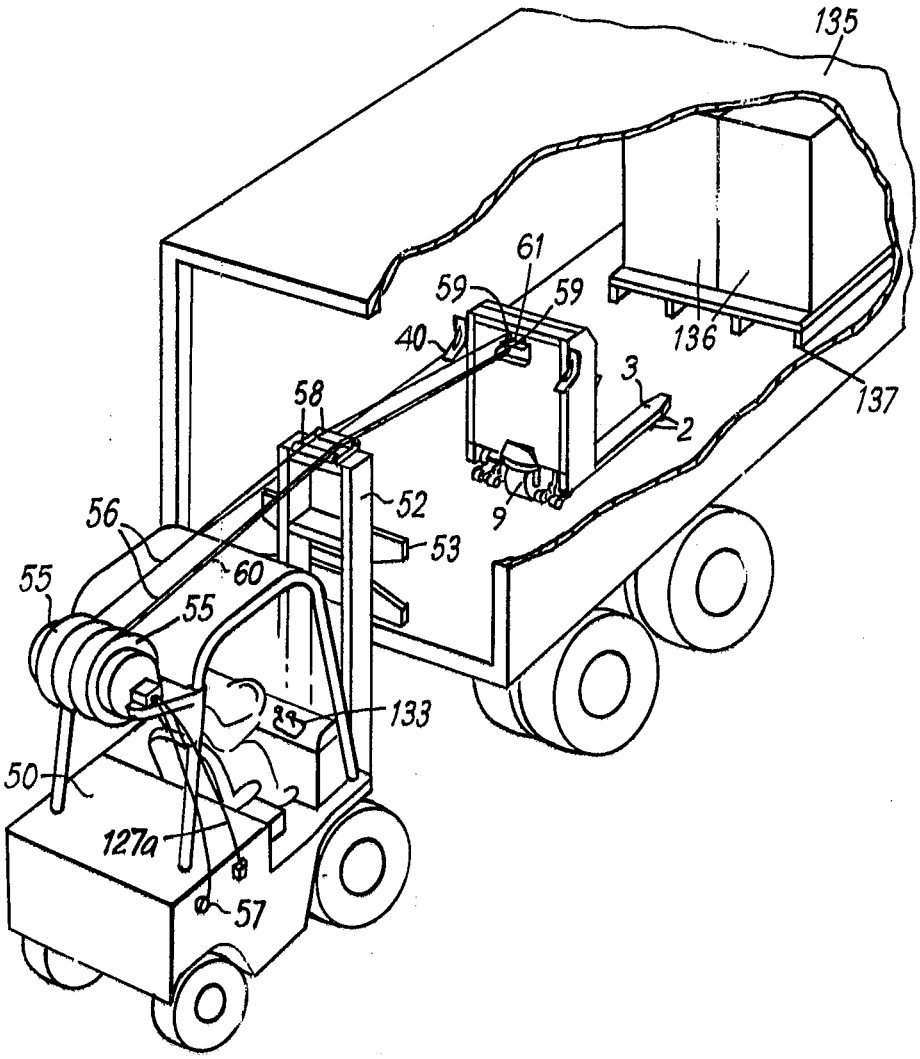
Figure 7:
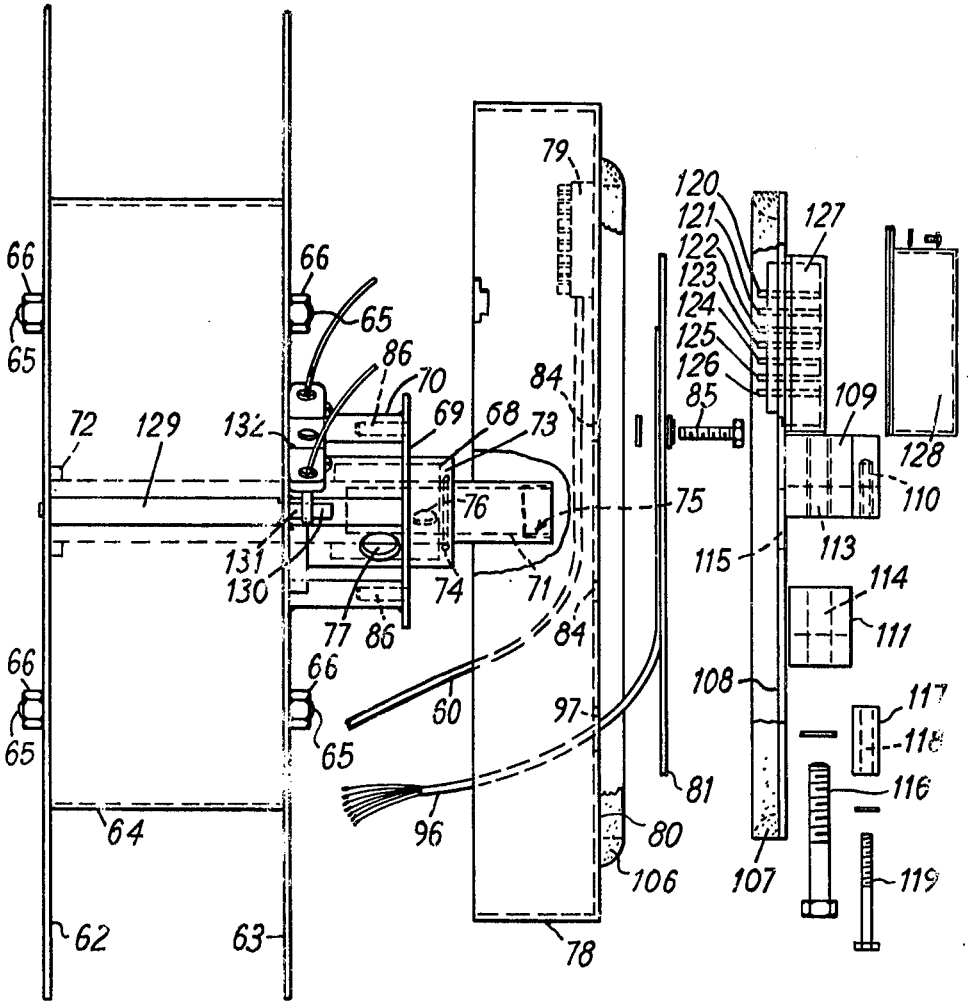
Figure 8:
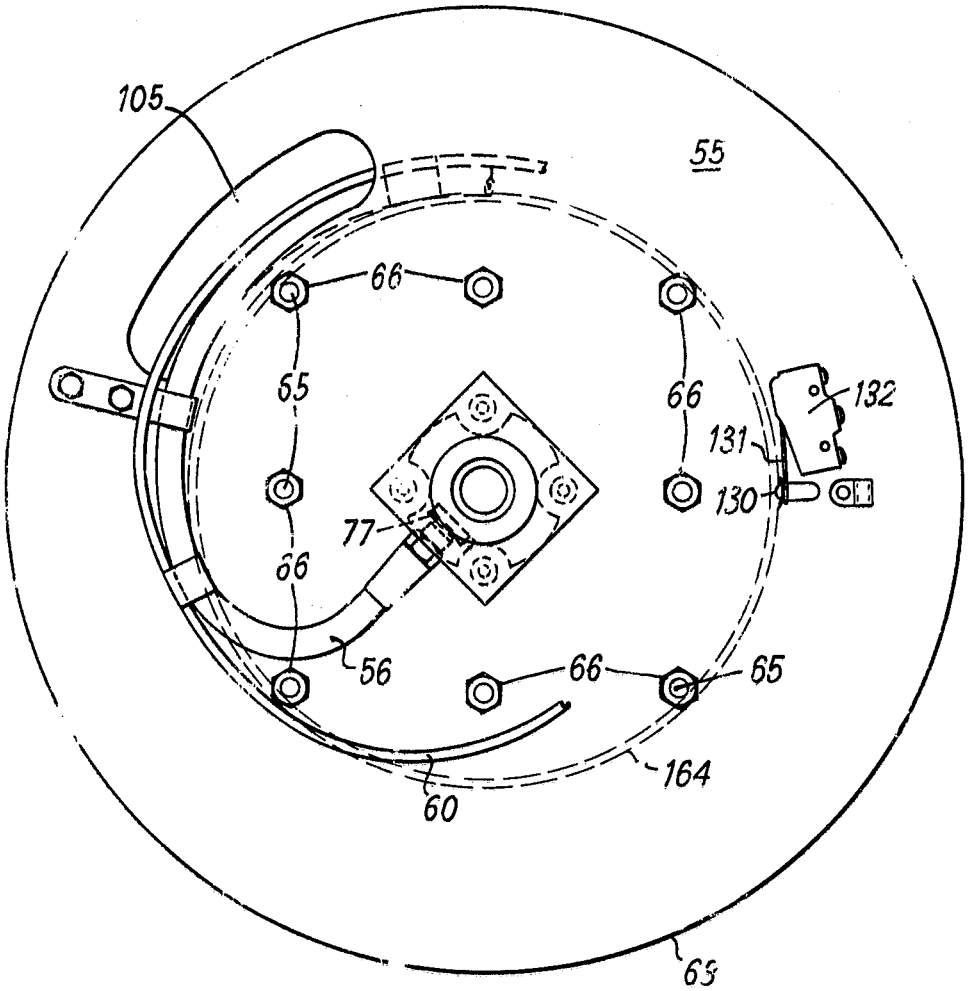
Figure 9:
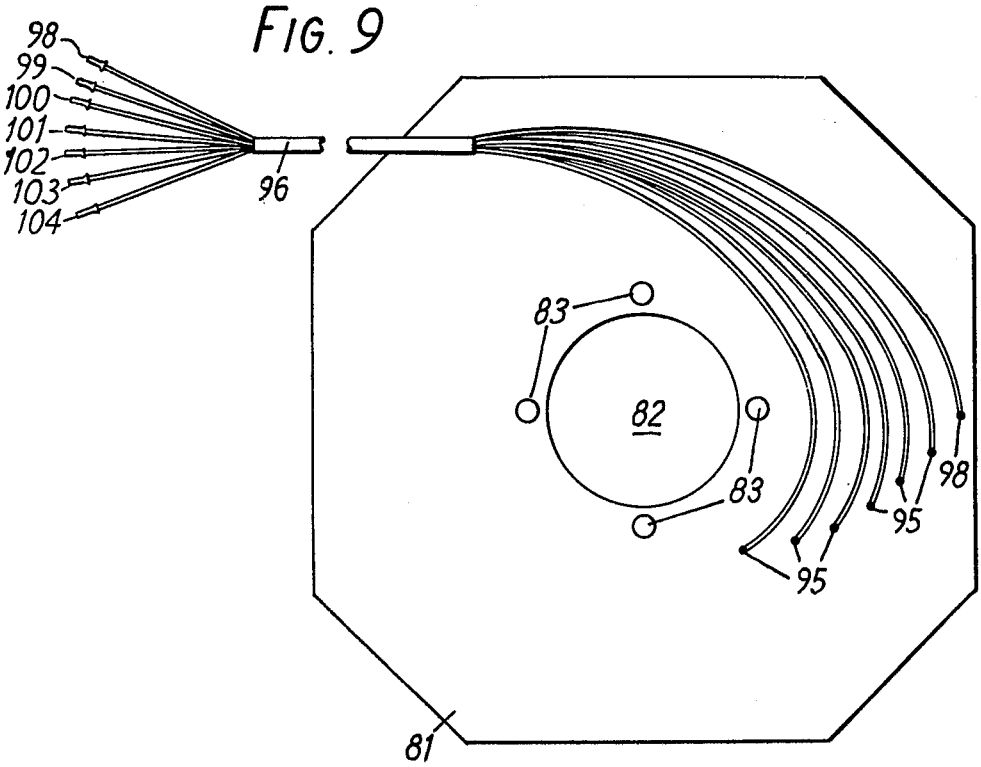
Figure 10:
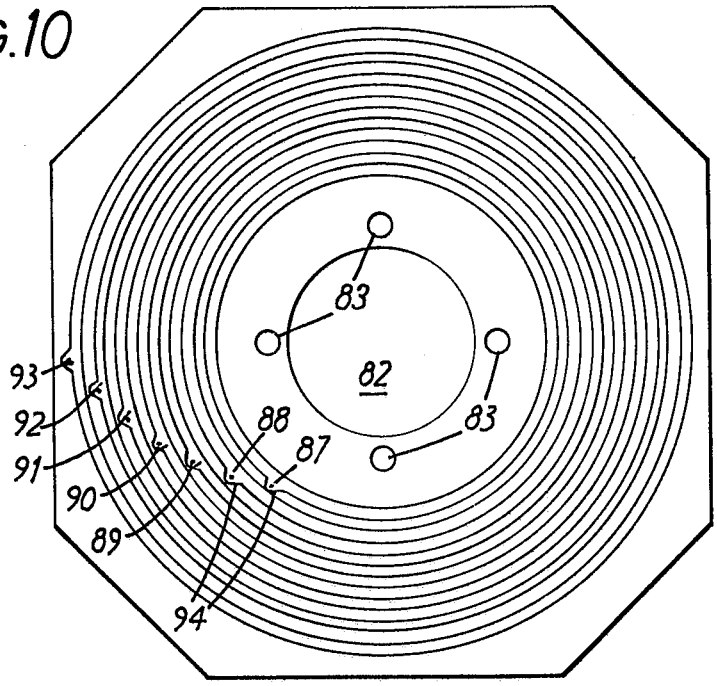

The invention may be performed in many ways but one embodiment will now be described by way of example and with reference to the accompanying drawings in which:

FIG. 1 is a side elevation of a device according to the invention, and showing the carriage plate of the lift truck, FIG. 2 is an end elevation of the device shown in FIG. 1, FIG. 3 is a plan view of the device shown in FIGS. 1 and 2, FIGS. 4 and 5 are diagramatic side views of the device in use, FIG. 6 is an isometric view of the device in use, FIG. 7 is an exploded side elevation of the reel used with the device, FIG. 8 is an end elevation of the reel shown in FIG. 7 with some parts removed, FIG. 9 is a side elevation of one side of part of the reel used with the device, FIG. 10 is a side elevation of the other side of the part shown in FIG. 7.

Figure 11:
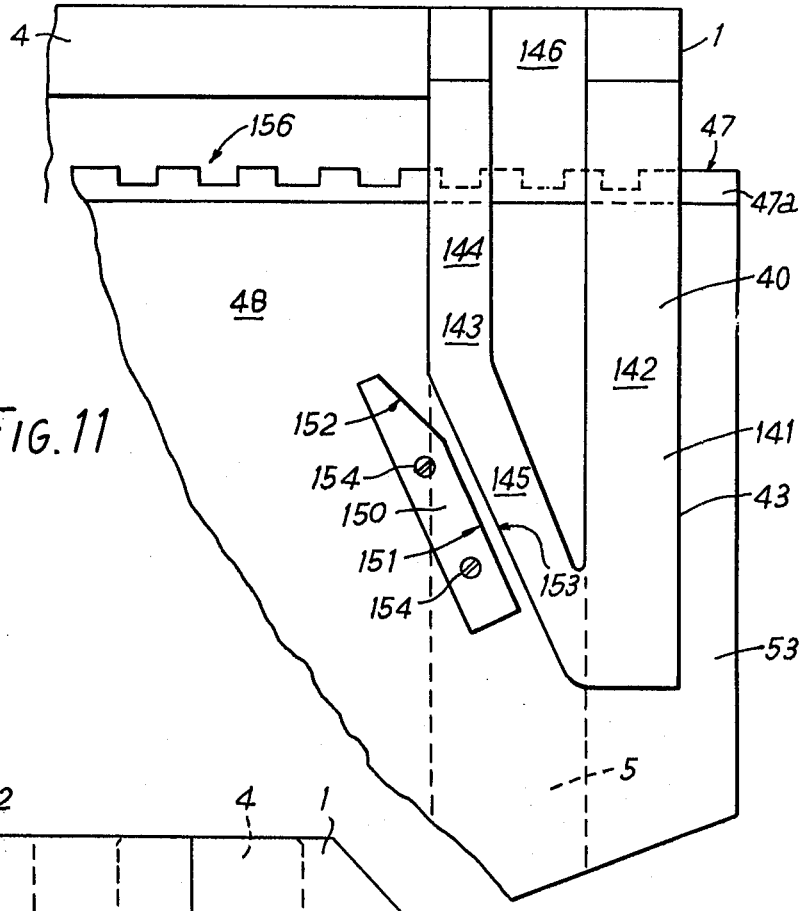
Figure 12:
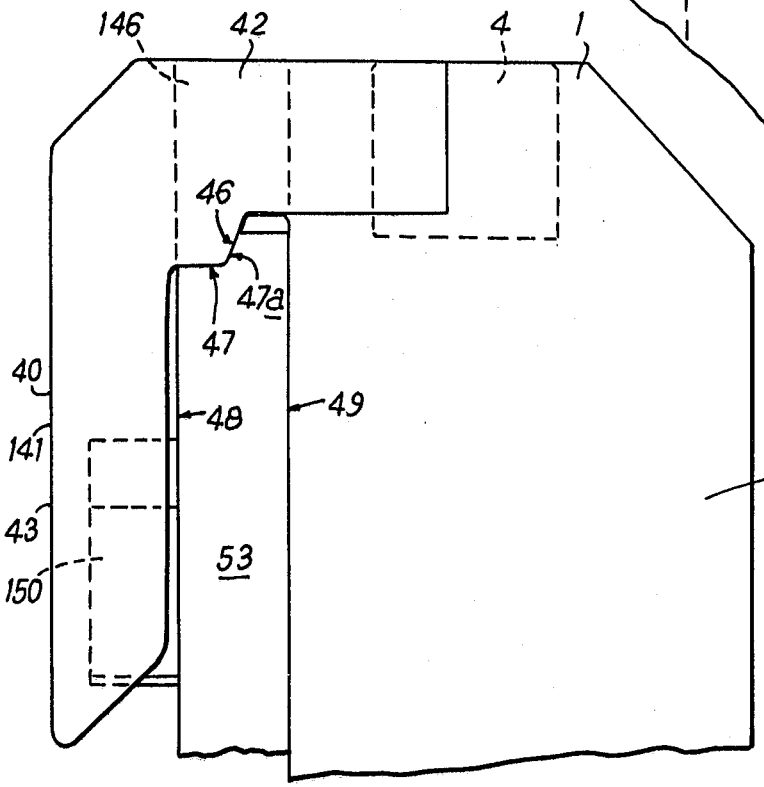

FIG. 11 is an end elevation of part of another construction of the device showing one of the hooks and part of the front carriage plate of the fork lift truck, and FIG. 12 is a side elevation of the construction shown in FIG. 11.

In the construction shown in the drawings the lifting and loading device according to the invention is intended for use with a forward loading fork lift truck. Such trucks have a standard front carriage plate to which the tines for the standard fork lift are connected. The carriage plate provides a vertically extending flat front surface and is carried on the mast of the fork lift truck up and down which it is moved. The tines are usually connected to the carriage plate by means of lugs or clips and to use the lift truck with the present device the tines are removed so that the carriage plate is bare.

The lifting and loading device for use with such a lift truck comprises a mobile platform 1 which is carried on rollers 2 which are located at the outer end of two tines 3. Each of the tines 3 is of channel shape cross section and the ends of the tines remote from the rollers are joined by a transversely extending element in the form of two vertically spaced apart members, the upper member 4 being in the form of box section having downwardly extending sides 5 which act as vertically extending guides for guide wheels 6 which are carried on a lower frame which comprises upwardly extending side members 7 and a lower cross member 8. The upper member 4 and sides 5 thus provide an upwardly extending end portion of the platform. The lower member 8 carries a supporting drive wheel 9 which is located in a pivoted mounting 10. The wheel is driven through a hydraulic motor incorporated in the hub of the wheel to which hydraulic fluid is supplied through hoses 11, 12, and the wheel is steered by double acting ram 13 connected between one of the side members 7 and a bell crank lever 14 which acts through a steering link 15 on a steering arm 16 connected to a turntable 17 as is most clearly shown in FIG. 2.

Relative movement between the upper member 4 and lower cross member 8 is controlled by a pair of hydraulic rams 18 in a manner to be described.

The raising and lowering of the rollers 2 is achieved through a mechanical linkage which is most clearly shown in FIG. 1. Each pair of wheels 2 on each tine 3 is carried on a carriage 19 which is pivoted at 20 to a lever 21. The other end of the lever 21 is pivoted at 22 to the tine and at 23 to a connecting rod 24 which extends along a channel 25 within each tine 3 to a bell crank lever 26 to which it is pivoted at 27. A bell crank lever 26 is provided at each side of the platform and each is pivoted at 28 to a lug 29 on the lower end of one of the downwardly extending sides 5 of the upper member 4. The other end of the lever 26 is connected to a pivoted arm 30 the upper end of which is pivoted at 31 to a downwardly projecting lug 32 on the lower part of one of the upwardly extending side members 7. The lower end of each arm 30 carries four stabilizing rollers 33.

Hydraulic pipelines indicated by reference numeral 34 are provided to supply operating fluid to the rams 18 so that they can be operated to move the members 4, 8 apart from each other in a vertical direction which thus causes the tines 2 to rise in relation to the drive wheel 9. As this movement takes place the lugs 29 move upwardly lifting the bell crank levers 26 relative to the pivoted arms 30 which causes bell crank lever 26 to pivot and move the connecting rods 24 to rotate the levers 21 to push the wheels 2 downwardly in relation to the tines at the same time the stabilizing rollers 33 are lowered. The whole height of the platform can therefore be raised and lowered by operation of the rams 18.

Electro-hydraulic valves indicated at 35 are provided in the hydraulic equipment to control the rams and connecting pipe lines, and cables (not shown in FIGS. 1, 2 and 3) extend to a suitable control gear on a lift truck in a manner to be described.

Hook means indicated by reference numeral 40 are provided at the upper end of each of the downwardly projecting side members 5. These means take the form of two hooks 41 each of which comprises a horizontally extending portion 42 and a downwardly projecting portion 43. This downwardly projecting portion is formed by a shaped plate 44 reinforced by a web 45, the whole being a welded assembly. Part of the horizontally extending portion 43 has a downwardly facing surface 46 which is oblique to a vertical plane at an angle of 20° and is shaped to co-operate with a shaped carriage plate on a fork lift truck in a manner to be described.

A fork lift truck embodying the invention is shown in FIGS. 4, 5 and 6. The truck is indicated by reference numeral 50 and is of the usual kind. The truck comprises a main body portion 51 housing the power means and a mast 52 up and down which a carriage plate 53 can be moved. When the truck is used for normal fork lift operations tines are clamped or otherwise secured to the carriage plate 53 in any known manner but these are removed when the truck is to be used with the device according to the invention.

The carriage plate 53 has an upper horizontally extending edge 47 (FIG. 1) from which depend a rearwardly facing side 48 and a forwardly facing side 49. The upper edge 47 has a rearwardly facing portion **47*a* which is oblique to a vertical plane at an angle of 20° the configuration being such that the hook elements 40 are configurated for interlocking engagement over the upper horizontally extending edge 47 for releasably suspending the auxiliary lifting and loading device therefrom. When the device is suspended in this manner the downwardly facing surface 46 engages the oblique portion 47*a* on the carriage plate as shown in broken lines in FIG. 1 and the lower part of the upwardly extending portion of the platform rests against the lower part of the front face 49 of the carriage plate. Due to the oblique angles of the surface 46 and portion 47***a* the load is transmitted to the plate in the most satisfactory manner and this helps to prevent twisting or buckling of the upper edge of the carriage plate 53. It will also be appreciated that the lowermost part of the horizontally extending portion 42 of each hook engages the lowermost part of the top surface of the horizontally extending edge of the carriage plate 53 thus preventing the highest portion of the carriage plate jamming at the upper end of the oblique surface 46 of the hook.

In FIGS. 11 and 12 an alternative hook construction is shown but the same reference numerals as those used in FIGS. 1, 2 and 3 are used to describe similar parts. As will be seen from FIGS. 11 and 12 each hook element 40 again comprises a horizontally extending portion 42 and downwardly projecting portion 43. The oblique downwardly facing surface 46 is again provided but in this case each of the hooks is made up from a forked member 141. Each fork member comprises an outer limb 142 and an inner limb 143, this inner limb 143 having a portion 144 parallel with the limb 142 and an angled portion 145. The upper ends of limbs 143 and 142 are secured as by welding to the upper end of the appropriate side member 5 and to the upper member 4 respectively. Each limb 142, 143 is shaped to provide an appropriate oblique lower surface 46 and a block 146 is located between the upper ends of the limbs. The block is held in position by screws or welding as is most convenient and the lower surface of the block is also shaped to provide a downwardly facing surface which is oblique to a vertical plane at an angle of 20° so that it is aligned with the oblique downwardly facing surfaces of the limbs 143 and 142 to provide a continuous downwardly facing surface 46 which has a horizontally extending length equal to the widths of the limbs 142, 143 and the block 146.

This hook can therefore work in a similar manner to that described with regard to the hook elements 40 described with regard to FIGS. 1, 2 and 3. In order to assist centralization of the device on the carriage plate 53 guide means ar provided on the carriage plate which operatively act on the auxiliary lifting and loading device to locate it in a predetermined horizontal position on the carriage plate when the hook elements are engaged over it. These means comprise a pair of horizontally spaced apart guide abutments 150 which are located on the rearwardly facing side 48 of the carriage plate 53. Each guide abutment 150 is in the form of a guide block secured to the rearwardly facing surface 48 of the carriage plate 53 to provide a guide surface 151 which is oblique to a vertical plane. The upper end of the guide surface 151 is provided with a chamfer 152 and the angle of the surface 151 is arranged so that it coincides with the angle of the lower surface 153 of the angled portion 145 of the limb 143 on the adjacent hook. The guide elements 150 can be welded to the back of the carriage plate 53 or may more conveniently be attached by screws 154 as indicated in FIG. 11. When the carriage plate engages hook elements 40 the plate can be raised until the upper edges of the guide abutments 150 engage the oblique surface 153 of the hooks and if the auxiliary lifting and loading device is out of alignment it can be shifted sideways as the carriage plate is raised until it is located centrally on the plate. It is important to obtain central location because out of balance forces can cause difficulties in handling the lift truck.

It will be appreciated that guide abutments can also be used with the hook construction shown in FIGS. 1, 2 and 3.

In the invention shown in FIGS. 11 and 12 the upper edge 47 of the carriage plate 53 is castellated as indicated at 156. These castellations although not being employed when the carriage plate is used with the auxiliary lifting and loading device offer a convenient means for accurately locating the tines when the fork lift truck is to be used with standard tine members.

The truck 1 is provided with a cage 54 which extends over the driver and mounted on this case are two rotatable drums 55. Each drum is loaded with a hydraulic hose 56 which emerges from the hollow centre of the drum spindle and continues to the appropriate fluid power connection 57 on the body of the truck. The free end of the hose emerges from the reel passes over a guide pulley 58 and is connected by a quick release self sealing valve 59 to a suitable connection on the upper frame 4 of the mobile platform. The connections are not shown in FIGS. 1, 2 and 3 for the sake of clarity. It will be seen that one of the drums around which one of the pipes is wrapped also carries an electric cable indicated by reference numeral 60 which is taped to the hose. The free end of this multi wire cable is connected by a multi plug socket 61 carried on the member 4, the socket being connected to the necessary electrical connections on the device.

The construction of the drum 55 is shown in FIGS. 7, 8, 9 and 10. The drum 55 comprises two circular end plates 62 and 63 which are arranged on each side of a hollow cylindrical hub 64, the assembly being fastened together by eight studs 65 secured by nuts 66. Rigidly secured to the plate 63 is a cylindrical housing 68 which is surrounded by an assembly plate 69 connected to the plate 63 by four pedestals 70. This assembly rotates about a spindle 71 on bearings 72 provided on the plate 62 and a bearing surface provided by the end wall 73 of the housing 68. In order to maintain the whole housing 68 liquid tight an O ring 74 is provided to seal between the end wall 73 and the surface of the spindle 71. Spindle 71 has a blind bore 75 the outer end of which is screw threaded to receive a hydraulic connection and the wall of the spindle is pierced by an opening 76 to allow fluid to pass from the bore 75 into the housing 68. The housing is provided with a port 77 which is also screw threaded to receive a hydraulic coupling.

A cylindrical cover 78 is provided which is placed over the location plate 69 and this cover carries an electrical connection block 79 for a seven wire connection. Located against the outer wall 80 of the cover 78 is a printed circuit plate 81 which is constructed as shown in FIGS. 9 and 10. This plate 81 which is octagonal has a central opening 82 which fits over the housing 68 when the plate is in position. Holes 83 are provided which are aligned with holes 84 in the wall 80 of housing 78 and which receive bolts, as indicated at 85 in FIG. 7 which pass through the plate and the casing and enter screw threaded bores 86 to hold the parts together. The board is provided with seven co-axial circular rhodiom faced copper tracks 87, 88, 89, 90, 91, 92, 93, each track having a connection lug 94. A hole 95 is drilled through the board immediately behind each lug to enable the seven wires of a seven wire cable to be passed through the hole and soldered to each of the lugs. The wires on the other side of the board are secured in position by adhesive and then held in a sleeve as indicated at 96. The cable thus formed is passed through an opening 97 in the wall 80 of the cover 78 and the seven wires indicated by reference numerals 98, 99, 100, 101, 102, 103, 104, are placed in the appropriate connectors in the connection box 79. The cable emerging from the connection box 79 is the cable 60 which passes through an opening 105 in the end plate 63.

The outer wall 80 of the drum carries a projecting rubber seal 106 and located within this is another co-operating rubber seal 107 which is carried on a co-assembly plate 108. This co-assembly plate is secured by welding to a block 109. The block has a part circular cut out 110 and co-operates with a second block 111 of similar dimensions in a manner to be described.

The block 110 has two tapped bores 113 and the block 111 has two tapped bores 114. The plate 108 has a bore 115 so that it can be slid over the spindle 71 and when bolts 116 are passed through the bores 114 and screwed into the bores 113 the plate 108 is held rigidly in position on the spindle with its seal 107 inside the seal 106. A support cap 117 is also provided which has bores 118 through which screws 119 are passed which enter screw threaded bores 110 in the block 109 to locate the cap in position on the spindle, and the support cap and blocks are connected to supports (not shown) which are carried by the case 54, so that the reel is rigidly located.

Arranged on the plates 108 are seven brushes 120-126 and these are carried in a mounting block 127 and are spring loaded by springs (not shown) in an outward direction. When the plate 108 is located in position the brushes 120-126 bear against the copper rings 87-93 so that electrical connections are established. A seven wire cable 127*a* (not shown in FIG. 7) is connected to the box 127 and extends to the power supply on the truck as shown in FIGS. 4, 5 and 6. A cover 128 is provided for the connection block.

The end of the hose 56 carrying the hydraulic fluid to the platform is connected to the port 77 as is clearly shown in FIG. 8 and the seven wire cable 60 is fastened to it with tape and they both pass through the opening 105 onto the drum. The hose and wire can therefore be unreeled from the drum without twisting, the electrical connections passing from the truck through the brushes and slip rings to the wire and the hydraulic connection passing through the spindle.

In order to prevent over stretching of the pipe and wire a limit switch is provided on the drum. This consists of a bar 129 which extends across the surface of the cylinder 64 between the side plates 62 and 63 and is pulled outwardly by a coil spring (not shown). An extended end 130 of the bar projects through an opening in the plate 63 but is held at the bottom of the opening by the cable and hose passing over it. When the cable and hose are lifted from the bar the spring pulls it outwardly so that it engages an operating arm on an electrical limit switch 132 which switches off the electrical power and prevents further movement of the platform away from the truck. A similar reel without electrical connections carries the other pip 56.

Power controls for operating the device are provided as an attachment to fit on the truck, the controls connecting up with the power controls of the truck in known fashion. The control box is indicated by reference numeral 133 on FIGS. 4, 5, and 6 and this control box can be supplied as a unit for connection into the truck controls.

The method of operating this lifting and loading device is shown in FIGS. 4, 5 and 6. In FIG. 4 a fork lift truck is shown which is carrying the platform with the hook means 40 hooked over the upper horizontally extending edge of the carriage plate 53. The lower part of the upwardly extending portion of the platform rests against the lower part of the face of the carriage plate. The platform is carrying a load, indicated by reference numeral 136 and this is being inserted into the mouth of the container. The rollers 2 and drive wheel 9 are lowered and the load is further inserted until the drive wheel 9 is also within the container. The carriage plate is now lowered until it is clear of the hook means 40 and the control gear 133 is then operated to drive the hydraulic motor in the wheel 9 so that the platform complete with load 136 moves off from the lifting assembly of the fork lift truck as shown in FIG. 5 until it reaches a suitable position where it is desired to deposit the load 136. It is in the mean-time steered by operating the ram 13, by the control gear 133 which controls the steerable driven wheel 9. When the load site is reached the rams 18 are operated to allow the members 8 and 4 to approach each other thus lowering the load, which will have been arranged on a suitable plate indicated by reference numeral 137 in FIG. 6, until it is supported on the lower surface of the container 135. The drive wheel 9 is then again operated to withdraw the unloaded platform back towards the lift truck as shown in FIG. 6. In this Figure however the fork lift truck is shown withdrawn from the container in order to make the drawing more clear although in practice it would be in the position shown in FIG. 5, that is immediately at the entrance to the container. The platform is withdrawn and steered back until the hook means 41 are immediately above the carriage plate 53 again by controlling the steerable wheel 9. With the platform in position the carriage plate is raised until the hooks engage over its upper edge and the platform is then lifted upwards with the carriage plate. The truck can now be backed away for further operations.

Power for the various controls is carried through the pipe lines and seven wired cable and as the reels are spring loaded they will reel in the pipes and cable as the truck is withdrawn.

During the operations the stabilizing rollers 33 prevent the platform from tipping.

In the arrangements described above hydraulic power is drawn from the lift truck 1 but many alternative arrangements could be used, for example, merely electrical power could be drawn from the truck and the hydraulic power source could be confined to the platform, hydraulic pressure being achieved by operating a pump driven by an electric motor. Again the operation of all the various components could be achieved by electric motors if this was more convenient, for example, the device could carry batteries to provide the power, the line from the truck merely acting as a central link to the power operated means on the device.

The drive wheel 9 could be arranged to one side of the platform if it was necessary in order to avoid interference with apparatus already provided on the fork lift truck.

If the truck is desired for normal use then the normal tines can be quickly replaced merely by lowering the carriage plates until the platform is resting on the ground in a suitable position, detaching the quick release connections to the pipes and cable, and backing the truck away. If desired the truck could of course be used as a fork lift truck utilising the device to provide the tines.

It will be appreciated that the invention includes a lift truck in combination with a lifting and loading device as set forth above.

What I claim is:

1. The combination of a power deriven lift truck and an auxiliary lifting and loading device wherein said auxiliary lifting and loading device is detachable from said lift truck and is individually operable from said lift truck; the improvement wherein said lift truck is provided with a vertically movable lifting assembly of the type including a lifting member having an upper horizontally extending edge; and said auxiliary lifting and loading device including a horizontally extending lower part having support wheel means and support elements and height adjustment means for raising and lowering said lower part in relation to said support wheel means and said support elements, and a vertically extending upper part connected to said lower part, said upper part having transversely spaced hook elements for vertical movement therewith, said hook elements being configurated for interlocking engagement over said lifting member upper horizontally extending edge for releasably suspending said auxiliary lifting and loading device therefrom, said lifting member upper horizontally extending edge having a rearwardly facing portion which is oblique to a vertical plane and each of said hook elements having a horizontally extending portion and a downwardly extending portion, part of said horizontally extending portion having a downwardly facing surface which is oblique to a vertical plane for engagement over said oblique rearwardly facing portion on said lifting member when in interlocking engagement therewith to urge said upper part against said lifting member, rollable support means carried by said support elements for co-operation with said support wheel means for supporting said auxiliary lifting and loading device independently of said lift truck, means for extending and retracting said rollable support means in response to operation of said height adjustment means for raising and lowering said lower part, a support frame carrying said support wheel means, a lifting frame guidably carried by said support frame, and lift means extending between said support frame and said lifting frame for vertically moving and positioning said lifting frame relative to said support frame, a lower portion of said lifting frame providing said horizontally extending lower part of said auxiliary lifting and loading device and carrying said rollable support means and also having an upper portion which provides said vertically extending upper part of said auxiliary lifting and loading device and carrying said hook elements.

2. In the combination of claim 1, stabilizing rolling means carried by said support frame adjacent said support wheel means, and means for lowering and raising said stabilizing rolling means in response to raising and lowering, respectively, said lifting frame.

3. In the combination of claim 2, linkage interconnecting said means for extending and retracting said rollable support means and said means for lowering and raising said stabilizing rolling means in unision.

4. In the combination of claim 3, wherein said linkage is in the form of a bell crank carried by said lifting frame for movement therewith.

5. In the combination of claim 1 wherein said support wheel means has incorporated therein powered drive means and steering means.

6. In the combination of claim 1 said auxiliary lifting and loading device having a drive system, electrically actuated control means carried by said auxiliary lifting and loading device for controlling the operation of said drive system, electric lines extending between said lift truck and said auxiliary lifting and loading device, an electrical control system on said lift truck coupled to said electrically actuated control means for actuating the same.

7. The combination of claim 6 wherein said drive system is a hydraulic system and hydraulic lines extend between said lift truck and said auxiliary lifting and loading device.

8. In the combination of a powerdriven lift truck and an auxiliary lifting and loading device wherein said auxiliary lifting and loading device is detachable from said lift truck and is individually operable from said lift truck; the improvement wherein said lift truck is provided with a vertically movable lifting assembly of the type including a lifting member having an upper horizontally extending edge; and said auxiliary lifting and loading device includes a horizontally extending lower part having centered single support wheel means and support elements and height adjustment means for raising and lowering said lower part in relation to said support wheel means and said support elements, and a vertically extending upper part connected to said lower part, said upper part having transversely spaced hook elements for vertical movement therewith, said hook elements being configurated for interlocking engagement over said lifting member upper horizontally extending edge for releasably suspending said auxiliary lifting and loading device therefrom, and stabilizing rolling means carried by said auxiliary lifting and loading device on opposite sides of said support wheel means, and means for lowering and raising said stabilizing rolling means in response to raising and lowering said lower part in relation to said support wheel means and said support elements, a support frame carrying said support wheel means, a lifting frame guidably carried by said support frame, and lift means extending between said support frame and said lifting frame for vertically moving and positioning said lifting frame relative to said support frame, a lower portion of said lifting frame providing said horizontally extending lower part of said auxiliary lifting and loading device and carrying said rollable support means and also having an upper portion which provides said vertically extending upper part of said auxiliary lifting and loading device and carrying said hook elements.

9. In the combination of claim 8, linkage interconnecting said means for extending and retracting said rollable support means and said means for lowering and raising said stabilizing rolling means in unison.

10. In the combination of claim 9 wherein said linkage is in the form of a bell crank carried by said lifting frame for movement therewith.

11. In the combination of claim 8 wherein said support wheel means has incorporated therein drive means and steering means.

12. In the combination of claim 8 said auxiliary lifting and loading device having a drive system, electrically actuated control means carried by said auxiliary lifting and loading device for controlling the operation of said drive system, electric lines extending between said lift truck and said auxiliary lifting and loading device, and an electrical control system on said lift truck coupled to said electrically actuated control means for actuating the same.

13. The combination of claim 12 wherein said drive system is a hydraulic system and hydraulic lines extend between said lift truck and said auxiliary lifting and loading device.

14. In the combination of a power driven lift truck and an auxiliary lifting and loading device wherein said auxiliary lifting and loading device is detachable from said lift truck and is individually operable from said lift truck; the improvement wherein said lift truck is provided with a vertically movable lifting assembly of the type including a lifting member having an upper horizontally extending edge; and said auxiliary lifting and loading device includes a horizontally extending lower part having support wheel means and support elements and height adjustment means for raising and lowering said lower part in relation to said support wheel means and said support elements, and a vertically extending upper part having transversely spaced hook elements for vertical movement therewith, said hook elements being configurated for interlocking engagement over said lifting member upper horizontally extending edge for releasably suspending said auxiliary lifting and loading device therefrom, cooperating guide means on said lifting member and said auxiliary lifting and loading device which operatively act to locate said auxiliary lifting and loading device in a predetermined transverse horizontal position on said lifting member when said hook elements are engaged over said lifting member, rollable support means carried by said support elements for cooperation with said support wheel means for supporting said auxiliary lifting and loading device independently of said lift truck, means for extending and retracting said rollable support means in response to operation of said height adjustment means for raising and lowering said lower part, a support frame carried by said support wheel means, a lifting frame guidably carried by said support frame, and lift means extending between said support frame and said lifting frame for vertically moving and positioning said lifting frame relative to said support frame, a lower portion of said lifting frame providing said horizontal extending lower part of said auxiliary lifting and loading device and carrying said rollable support means and also having an upper portion which provides said vertically extending upper part of said auxiliary loading and lifting device and carrying said hook elements.

15. In the combination of claim 14, wherein said lifting member upper horizontally extending edge has a rearwardly facing portion which is oblique to a vertical plane and each of said hook elements has a horizontally extending portion and a downardly extending portion, part of said horizontally extending portion having a downwardly facing surface which is oblique to a vertical plane for engagement over said oblique rearwardly facing portion on said lifting member when in interlocking engagement therewith.

16. In the combination of a power driven lift truck and an auxiliary lifting and loading device wherein said auxiliary lifting and loading device is detachable from said lift truck and is individually operable from said lift truck; the improvement wherein said lift truck is provided with a vertically movable lifting assembly of the type including a lifting member having an upper horizontally extending edge; and said auxiliary lifting and loading device includes a horizontally extending lower part having support wheel means and support elements and height adjustment means for raising and lowering said lower part in relation to said support wheel means and said support elements, and a vertically extending upper part connected to said lower part for movement therewith, said upper part having transversely spaced hook elements for vertical movement therewith, said hook elements being configurated for interlocking engagement over said lifting member upper horizontally extending edge for releasably suspending said auxiliary lifting and loading device therefrom, cooperating guide means on said lifting member and said auxiliary lifting and loading device which operatively act to locate said auxiliary lifting and loading device in a predetermined transverse horizontal position on said lifting member when said hook elements are engaged over said lifting member, rollable support means carried by said support elements for cooperation with said support wheel means for supporting said auxiliary lifting and loading device independently of said lift truck, means for extending and retracting said rollable support means in response to operation of said height adjustment means for raising and lowering said lower part, a support frame carried by said support wheel means, a lifting frame guidably carried by said support frame, and lift means extending between said support frame and said lifting frame for vertically moving and positioning said lifting frame relative to said support frame, a lower portion of said lifting frame providing said horizontal extending lower part of said auxiliary lifting and loading device and carrying said rollable support means and also having an upper portion which provides said vertically extending upper part of said auxiliary loading and lifting device and carrying said hook elements, said lifting member having a rearwardly facing side and a forward facing side, both of said sides extending downwardly from said upper horizontally extending edge, and said cooperating guide means including said rearwardly facing side having projecting guide abutments configurated for guiding engagement with said hook elements.

17. In the combination of claim 16 wherein said cooperating guide means further includes said hook elements having chamferred sides to co-operate with said guide abutments when engaged thereby.

18. In the combination of claim 16 said auxiliary lifting and loading device including a support frame carrying said support wheel means, a lifting frame guidably carried by said support frame, and lift means extending between said support frame and said lifting frame for vertically moving and positioning said lifting frame relative to said support frame, a lower portion of said lifting frame providing said horizontally extending lower part of said auxiliary lifting and loading device and carrying said rollable support means and also having an upper portion which provides said vertically extending upper part of said auxiliary lifting and loading device and carrying said hook elements.

19. In the combination of claim 18, wherein said support wheel means is in the form of a single transversely centered support wheel, and there are stabilizing rolling means carried by said support frame on opposite sides of said single support wheel, and means for lowering and raising said stabilizing rolling means in response to raising and lowering, respectively, said lifting frame.

20. In the combination of claim 19, wherein said rollable support means and said stabilizing rolling means are in longitudinal alignment, and there is linkage interconnecting said means for extending and retracting said rollable support means and said means for lowering and raising said stabilizing rolling means in unison.

21. In the combination of claim 20, wherein said linkage is in the form of a bell crank carried by said lifting frame for movement therewith.

22. In the combination of claim 16 wherein said support wheel means has incorporated therein drive means and steering means.

23. In the combination of claim 16, said auxiliary lifting and loading device having a drive system, electrically actuated control means carried by said auxiliary lifting and loading device for controlling the operation of said drive system, electric lines extending between said lift truck and said auxiliary lifting and loading device, means for storing said auxiliary lifting and loading device, and an electrical control system on said lift truck coupled to said electrically actuated control means for actuating the same.

24. The combination of claim 23 wherein said drive system is a hydraulic system and hydraulic lines extend between said lift truck and said auxiliary lifting and loading device.

25. An auxiliary lifting and loading device particularly adapted for use in combintion with a lift truck of the type having a vertically movable lifting assembly including a lifting member having an upper horizontally extending edge which has a rearwardly facing portion which is oblique to a vertical plane, said auxiliary lifting and loading device including a horizontally extending lower part having support wheel means and support elements and height adjustment means for raising and lowering said lower part in relation to said support wheel means and said support elements, and a vertically extending upper part connected to said lower part, said upper part having transversely spaced hook elements for vertical movement therewith, said hook elements being configurated for interlocking engagement over said lifting member for releasably suspending said auxiliary lifting and loading device therefrom, each of said hook elements having a horizontally extending portion and a downwardly facing surface which is oblique to a vertical plane for engagement over said oblique facing portion on said lifting member when in interlocking engagement therewith forcing said auxiliary lifting and loading device upper part against a front face of said lifting member, rollable support means carried by said support elements for co-operation with said support wheel means for supporting said auxiliary lifting and loading device independently of said lift truck, means for extending and retracting said rollable support means in response to operation of said height adjustment means for raising and lowering said lower part, a support frame carried by said support wheel means, a lifting frame guidably carried by said support frame, and lift means extending between said support frame and said lifting frame for vertically moving and positioning said lifting frame relative to said support frame, a lower portion of said lifting frame providing said horizontal extending lower part of said auxiliary lifting and loading device and carrying said rollable support means and also having an upper portion which provides said vertically extending upper part of said auxiliary loading and lifting device and carrying said hook elements.

26. An auxiliary lifting and loading device as claimed in claim 25 wherein said support wheel means is in the form of a single transversely centered support wheel, and there are carrying stabilizing rolling means on opposite sides of said single support wheel, and means for lowering and raising said stabilizing means in response to raising and lowering said lower part in relation to said support wheel means and said support elements.

27. An Auxiliary lifting and loading device particularly adapted for use in combination with a lift truck of the type having a vertically movable lifting assembly including a lifting member having an upper horizontally extending edge, said auxiliary lifting and loading device including a horizontally extending lower part having a single centered power driven support wheel means and support elements and height adjustment means for raising and lowering said lower part in relation to said support wheel means and said support elements, and a vertically extending upper part connected to said lower part, said upper part having transversely spaced hook elements mounted for vertical movement therewith, said hook elements being configurated for interlocking engagement over said lifting upper horizontally extending edge for releasably suspending said auxiliary lifting and loading device therefrom, and stabilizing rolling means carried on opposite sides of said support wheel means, means for lowering and raising said stabilizing rolling means in response to raising and lowering said lower part in relation to said support wheel means and said support elements, rollable support means carried by said support elements for co-operation with said support wheel means for supporting said auxiliary lifting and loading device independently of said lift truck, means for extending and retracting said rollable support means in response to operation of said height adjustment means for raising and lowering said lower part, a support frame carried by said support wheel means, a lifting frame guidably carried by said support frame, and lift means extending between said support frame and said lifting frame for vertically moving and positioning said lifting frame relative to said support frame, a lower portion of said lifting frame providing said horizontal extending lower part of said auxiliary lifting and loading device and carrying said rollable support means and also having an upper portion which provides said vertically extending upper part of said auxiliary loading and lifting device and carrying said hook elements.

28. A power driven lift truck particularly adapted for use in combination with an auxiliary lifting and loading device which is detachable from said lift truck and is individually operable from said lift truck, said lift truck having a vertically movable lifting assembly of the type including a lifting member having an upper horizontally extending edge, said auxilary lifting and loading device including a horizontally extending lower part having support wheel means and support elements and height adjustment means for raising and lowering said lower part in relation to said support wheel means and said support elements, and a vertically extending upper part connected to said lower part, said upper part having transversely spaced hook elements for vertical movement therewith, said hook elements being configurated for interlocking engagement over said lifting upper horizontally extending edge for releasably suspending said auxiliary lifting and loading device therefrom, and transversely spaced guide means on said lifting member which operatively act on said auxiliary lifting and loading device to locate it in a predetermined transverse horizontal position on said lifting member when said hook elements are engaged over said lifting member, said lifting member having a rearwardly facing side and a forward facing side, both of said sides extending downwardly from said upper horizontally extending edge, said guide means including said rearwardly facing side having projecting guide abutments configurated for guiding engagement with said hook elements.

29. The combination of claim 28 wherein said support wheel means is steerable and there are electrically controlled hydraulic steering means.

30. The combination of a power driven lift truck and an auxiliary lifting and loading device, said lift truck having a vertically movable lifting assembly including a transversely elongated lifting member having an upper horizontally extending edge, said auxiliary lifting and loading device including a horizontally extending lower part having a single centered power driven support wheel means and support elements and height adjustment means for raising and lowering said lower part in relation to said support wheel means and said support elements, and a vertically extending upper part connected to said lower part, said upper part having transversely spaced hook elements mounted for vertical movement therewith, said hook elements being configurated for interlocking engagement over said lifting upper horizontally extending edge for releasably suspending said auxiliary lifting and loading device therefrom, and stabilizing rolling means carried on opposite sides of said support wheel means, and means for lowering and raising said stabilizing rolling means in response to raising and lowering said lower part in relation to said support wheel means and said support elements, said support wheel means and said height adjustment means having drive units, electrical control members coupled to said drive units for controlling the actuation thereof, said lift truck having electrical control means, electrical lines extending between said electrical control means and said control members for the remote controlling of said auxiliary lifting and loading device from said lift truck, rollable support means carried by said support elements for co-operation with said support wheel means for supporting said auxiliary lifting and loading device independently of said lift truck, means for extending and retracting said rollable support means in response to operation of said height adjustment means for raising and lowering said lower part, a support frame carried by said support wheel means, a lifting frame guidably carried by said support frame, and lift means extending between said support frame and said lifting frame for vertically moving and positioning said lifting frame relative to said support frame, a lower portion of said lifting frame providing said horizontal extending lower part of said auxiliary lifting and loading device and carrying said rollable support means and also having an upper portion which provides said vertically extending upper part of said auxiliary loading and lifting device and carrying said hook elements.

* * * * *